US008544767B2

(12) United States Patent
Adachi et al.

(10) Patent No.: US 8,544,767 B2
(45) Date of Patent: Oct. 1, 2013

(54) FUEL INJECTION DEVICE

(75) Inventors: Naofumi Adachi, Takahama (JP); Tsukasa Yamashita, Kariya (JP)

(73) Assignee: Denso Corporation, Kariya (JP)

( * ) Notice: Subject to any disclaimer, the term of this patent is extended or adjusted under 35 U.S.C. 154(b) by 131 days.

(21) Appl. No.: 13/179,764

(22) Filed: Jul. 11, 2011

(65) Prior Publication Data

US 2012/0012680 A1 Jan. 19, 2012

(30) Foreign Application Priority Data

Jul. 14, 2010 (JP) ..... 2010-159928

(51) Int. Cl.
*B05B 9/00* (2006.01)

(52) U.S. Cl.
USPC ..... 239/124; 239/533.2; 239/88; 239/585.1; 123/445; 123/467

(58) Field of Classification Search
USPC ..... 239/124, 533.2, 88, 585.1; 123/467, 123/445, 457, 514, 518; 137/312
See application file for complete search history.

(56) References Cited

U.S. PATENT DOCUMENTS 6,892,955 B2 * 5/2005 Grabandt ..... 239/88
7,051,958 B2 * 5/2006 Sander-Potz et al. ..... 239/533.2

FOREIGN PATENT DOCUMENTS

CN 1510268 7/2004
WO WO 00/60233 10/2000

OTHER PUBLICATIONS

Office Action (6 pages) dated May 28, 2013 issued in corresponding Chinese Application No. 201110204573.2 and English translation (5 pages).

* cited by examiner

*Primary Examiner* — Dinh Q Nguyen
(74) *Attorney, Agent, or Firm* — Nixon & Vanderhye PC

(57) ABSTRACT

A fuel injection device has therein a recovery channel provided in a first valve body, and a fuel channel provided in the first valve body and a second valve body. The fuel channel is opened by openings at a first end surface of the first valve body and a second end surface of the second valve body. One of the first end surface and the second end surface is provided with an end surface groove connected to the recovery channel. In the fuel injection device, the end surface groove is provided to enclose at least a part of the opening and is separated from the opening by a clearance, and one of the first valve body and the second valve body has a side surface groove extending in a circumferential direction at an outer periphery of the one of the first valve body and the second valve body.

6 Claims, 7 Drawing Sheets

FUEL INJECTION DEVICE

CROSS REFERENCE TO RELATED APPLICATION

This application is based on Japanese Patent Application No. 2010-159928 filed on Jul. 14, 2010, the contents of which are incorporated herein by reference in its entirety.

TECHNICAL FIELD

The present invention relates to a fuel injection device provided with a fuel channel for supplying high-pressure fuel to an injection hole, and a recovery channel for recovering leakage fuel leaked from the fuel channel.

BACKGROUND

Generally, a fuel injection device is configured by combining plural cylindrical valve bodies in which a high-pressure fuel channel is formed therein. The fuel channel formed in each valve body is open at an end surface of each valve body in an axial direction. An axial force is applied to the plural valve bodies by using a fastening member, such that the end surfaces of the plural valve bodies opened in an axial direction liquid-tightly contact each other.

Even in this case, the high-pressure fuel in the fuel channel of the fuel injection device may be easily leaked from a space between the end surfaces of the valve bodies. In a fuel injection device described in Patent Document 1 (WO 00/60233), one of the end surfaces of the adjacent valve bodies has an end surface groove recessed from the end surface. Furthermore, a recovery channel for recovering leakage fuel leaked from the fuel channel is formed in the valve body. The recovery channel is connected to the end surface groove, so that the leakage fuel leaked to the end surface groove can be recovered via the recovery channel.

In the fuel injection device described in Patent Document 1, the contact area between the end surfaces of the adjacent valve bodies adjacent to each other in the axial direction can be reduced by the end surface groove.

However, recently, the pressure of the fuel supplied to the fuel injection device is increased more and more. When an abnormity is caused in a supply portion for supplying a high-pressure fuel to the fuel injection device, the pressure of the fuel in the fuel channel may be increased remarkably.

In the fuel injection device described in Patent Document 1, when an axial force is applied to the valve bodies so as to liquid-tightly contact the end surfaces of the valve bodies, the surface pressure caused between the end surface portions at an inner peripheral side of the end surface groove is substantially equal to the surface pressure caused between the end surface portions at an outer peripheral side of the end surface groove. In this case, the axial force applied to the end surfaces of the valve bodies is distributed in the end surface portions, and the surface pressure may be insufficient for liquid-tightly contacting the end surface portions at the inner peripheral side of the end surface groove. If the fuel is continuously leaked from the fuel channel to the end surface groove, the recovery of the leakage fuel via the recovery channel connected to the end surface groove may be insufficient. Thus, if the fuel pressure in the end surface groove is increased, the fuel may be leaked from the end surface groove to the outside of the fuel injection device. Therefore, it may be difficult to prevent a fuel leakage to an outside of the fuel injection device in Patent Document 1.

SUMMARY

The present invention is made in view of the above matters, and it is an object of the present invention to provide a fuel injection device, which can prevent a fuel leakage from a fuel channel to an outside.

According to an aspect of the present invention, a fuel injection device is provided with a fuel channel through which a high-pressure fuel is supplied to an injection hole, and a recovery channel through which the fuel leaked from the fuel channel is recovered. The fuel injection device includes: a first valve body in which the fuel channel and the recovery channel are provided, the first valve body having a first end surface at which the fuel channel is opened by an opening; a second valve body in which the fuel channel is formed, the second valve body having a second end surface at which the fuel channel is opened by an opening, the second end surface of the second valve body facing the first end surface of the first valve body; and a force applying member disposed to apply a force to the first valve body and the second valve body, such that the first end surface and the second end surface liquid-tightly contact each other by using the applied force from the force applying member. In the fuel injection device, one of the first end surface and the second end surface is provided with an end surface groove connected to the recovery channel, the end surface groove is provided to enclose at least a part of the opening and is separated from the opening by a clearance, and at least one of the first valve body and the second valve body has a side surface groove extending in a circumferential direction at an outer periphery of the at least one of the first valve body and the second valve body.

Because at least one of the first valve body and the second valve body has the side surface groove extending in a circumferential direction at an outer periphery of the at least one of the first valve body and the second valve body, the strength of the outer peripheral side of the at least one of the first valve body and the second valve body is lower than the strength of the inner peripheral side of the at least one of the first valve body and the second valve body. Thus, an end surface portion at the outer peripheral side is easily deformed than an end surface portion at the inner peripheral side, in the first end surface or the second end surface of the at least one of the first valve body and the second valve body having the side groove. Accordingly, if an axial force is applied to the first valve body and the second valve body from the force applying member, the force from the force applying member can be concentrically applied to the end surface portion at the inner peripheral side of the end surface groove. As a result, a high surface pressure can be caused between the end surface portions at the inner peripheral side of the end surface groove, as compared with the outer peripheral side of the end surface groove.

Thus, even when the pressure in the fuel channel is increased, the end surface portions at the inner peripheral side of the end surface groove can liquid-tightly contact each other between the first end surface and the second end surface of the first and second valve bodies. Accordingly, an amount of leakage fuel leaked from the fuel channel to the end surface groove can be reduced. Therefore, a recovery of the leakage fuel via the recovery channel connected to the end surface groove can be accurately and sufficiently performed, thereby preventing an increase of the fuel pressure in the recovery channel and the end surface channel. As a result, the fuel injection device can prevent a leakage of the fuel leaked from the fuel channel to the outside.

For example, the side surface groove may be recessed radially inside from the outer periphery of the one of the first valve body and the second valve body to have a recessed bottom, and the recessed bottom may be positioned radially inside of an outer periphery of the end surface groove. Furthermore, the side surface groove may be provided in the second valve body.

The side surface groove may be provided along an entire periphery of at least one of the first valve body and the second valve body. Alternatively/Further, the end surface groove may be provided to continuously extend in a circumferential direction around an outer periphery of the opening of the fuel channel.

As an example, the openings of the fuel channel opened respectively at the first end surface and the second end surface may be circular shapes or circular ring shapes, which are concentric with each other, and the end surface groove and the side surface groove may have respectively circular ring shapes that are concentric with the openings of the fuel channel respectively opened at the first end surface and the second end surface.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF THE PREFERRED EMBODIMENTS

Figure 1:
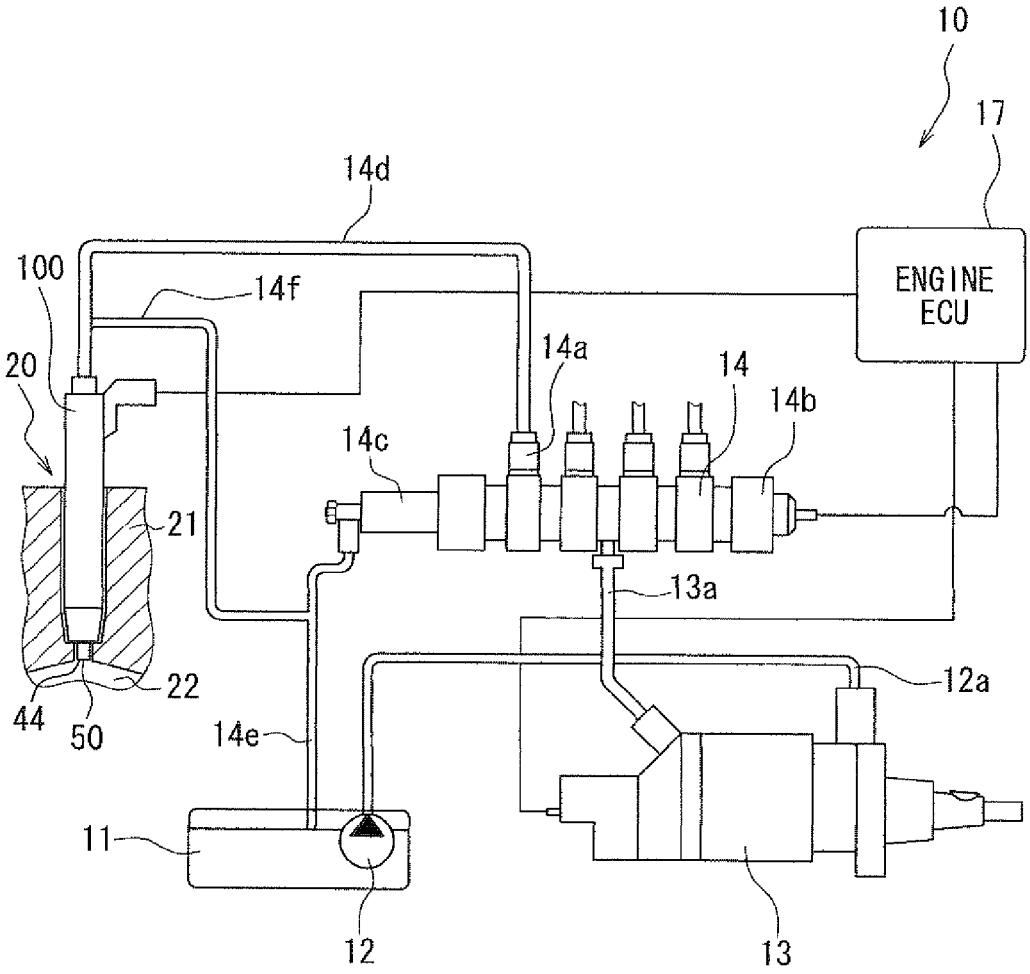
FIG. 1 is a schematic diagram of a fuel supply system having a fuel injection device according to a first embodiment of the present invention.

Embodiments of the present invention will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A fuel supply system 10, in which a fuel injection device 100 according to a first embodiment of the present invention is used, is shown in FIG. 1. The fuel injection device 100 of the present embodiment is a so-called direct injection fuel supply system in which fuel is directly injected into a combustion chamber 22 of a diesel engine 20 as an internal combustion engine.

The fuel supply system 10 is constructed of a feed pump 12, a high-pressure fuel pump 13, a common rail 14, an engine control device 17 (engine ECU), the fuel injection device 100, and the like.

The feed pump 12 is an electrically driven pump and is housed in a fuel tank 11. The feed pump 12 applies a feed pressure to fuel stored in the fuel tank 11, such that the feed pressure is higher than the vapor pressure of the fuel. The feed pump 12 is connected to the high-pressure fuel pump 13 with a fuel pipe 12*a* and supplies the liquid-state fuel, which has a predetermined feed pressure applied thereto, to the high-pressure fuel pump 13. The fuel pipe 12*a* has a pressure control valve (not shown) fitted thereto and the pressure of the fuel supplied to the high-pressure fuel pump 13 is held at a specified value by the pressure control valve.

The high-pressure fuel pump 13 is attached to the diesel engine 20 and is driven by power from an output shaft of the diesel engine 20. The high-pressure fuel pump 13 is connected to the common rail 14 by a fuel pipe 13*a*, and further applies pressure to the fuel supplied by the feed pump 12 to supply a high-pressure fuel to the common rail 14. In addition, the high-pressure fuel pump 13 has an electromagnetic valve (not shown) electrically connected to the engine control device 17. The electromagnetic valve is opened or closed by the engine control device 17, and thereby the pressure of the fuel supplied from the high-pressure fuel pump 13 to the common rail 14 is optimally controlled to a predetermined pressure.

The common rail 14 is a pipe-shaped member made of a metal material such as chromium molybdenum steel and has a plurality of branch parts 14*a*. The number of the plurality of branch parts 14 corresponds to the number of cylinders per bank of the diesel engine. Each of the branch parts 14*a* is connected to the fuel injection device 100 by a fuel pipe forming a supply channel 14*d*. The fuel injection device 100 and the high-pressure fuel pump 13 are connected to each other by a fuel pipe forming a return channel 14*f*. According to the above-mentioned construction, the common rail 14 temporarily stores the fuel supplied in a high-pressure state by the high-pressure fuel pump 13, and distributes the fuel to the plurality of fuel injection devices 100 with the pressure held in the high-pressure state through the supply channels 14*d*. In addition, the common rail 14 has a common rail sensor 14*b* provided at one end portion of both end portions in an axial direction, and has a pressure regulator 14*c* provided at the other end portion thereof. The common rail sensor 14*b* is electrically connected to the engine control device 17 and detects the pressure and the temperature of the fuel and outputs them to the engine control device 17. The pressure regulator 14*c* maintains the pressure of the fuel in the common rail 14 at a constant value, and decompresses and discharge excess fuel to a low-pressure side. The excess fuel passing through the pressure regulator 14*c* is returned to the fuel tank 11 through a channel in a fuel pipe 14*e* that connects the common rail 14 to the fuel tank 11.

The fuel injection device 100 is a device for pressurizing a fuel and for injecting high-pressure fuel supplied through the branch part 14*a* of the common rail 14, from an injection hole 44. Specifically, the fuel injection device 100 has a valve portion 50 that controls the injection of the high-pressure fuel injected from the nozzle hole 44 according to a control signal from the engine control device 17. The high-pressure fuel is supplied from the high-pressure pump 13 through the supply channel 14*d*. In addition, in the fuel injection device 100, the excess fuel, which is a portion of the high-pressure fuel supplied from the supply channel 14*d* and is not injected from the nozzle hole 44, is discharged into the return channel 14*f* through which the fuel injection device 100 communicates with the high-pressure fuel pump 13, and then is returned to the fuel tank 11. The fuel injection device 100 is inserted into and fitted into an insertion hole made in a head member 21 that is a portion of the combustion chamber 22 of the diesel engine 20. In the present embodiment, a plurality of the fuel injection devices 100 are arranged for respective combustion chambers 22 of the diesel engine 20 and each of them injects the fuel directly into the combustion chamber 22, specifically, with an injection pressure of a range from 160 to 220 mega Pascal (MPa).

The engine control device 17 is constructed of a microcomputer or the like. The engine control device 17 is electrically connected to not only the common rail sensor 14*b* described above but also various kinds of sensors such as a rotational speed sensor for detecting the rotational speed of the diesel engine 20, a throttle sensor for detecting a throttle opening, an air flow sensor for detecting an intake air volume, a boost pressure sensor for detecting a boost pressure, a water temperature sensor for detecting a cooling water temperature, and an oil temperature sensor for detecting the oil temperature of lubricating oil. The engine control device 17 outputs an electric signal for controlling the opening/closing of the electromagnetic valve of the high-pressure fuel pump 13 and the valve portion 50 of each fuel injection device 100, to the electromagnetic valve of the high-pressure fuel pump 13 and to each fuel injection device 100 on the basis of information from these respective sensors.

Figure 2:
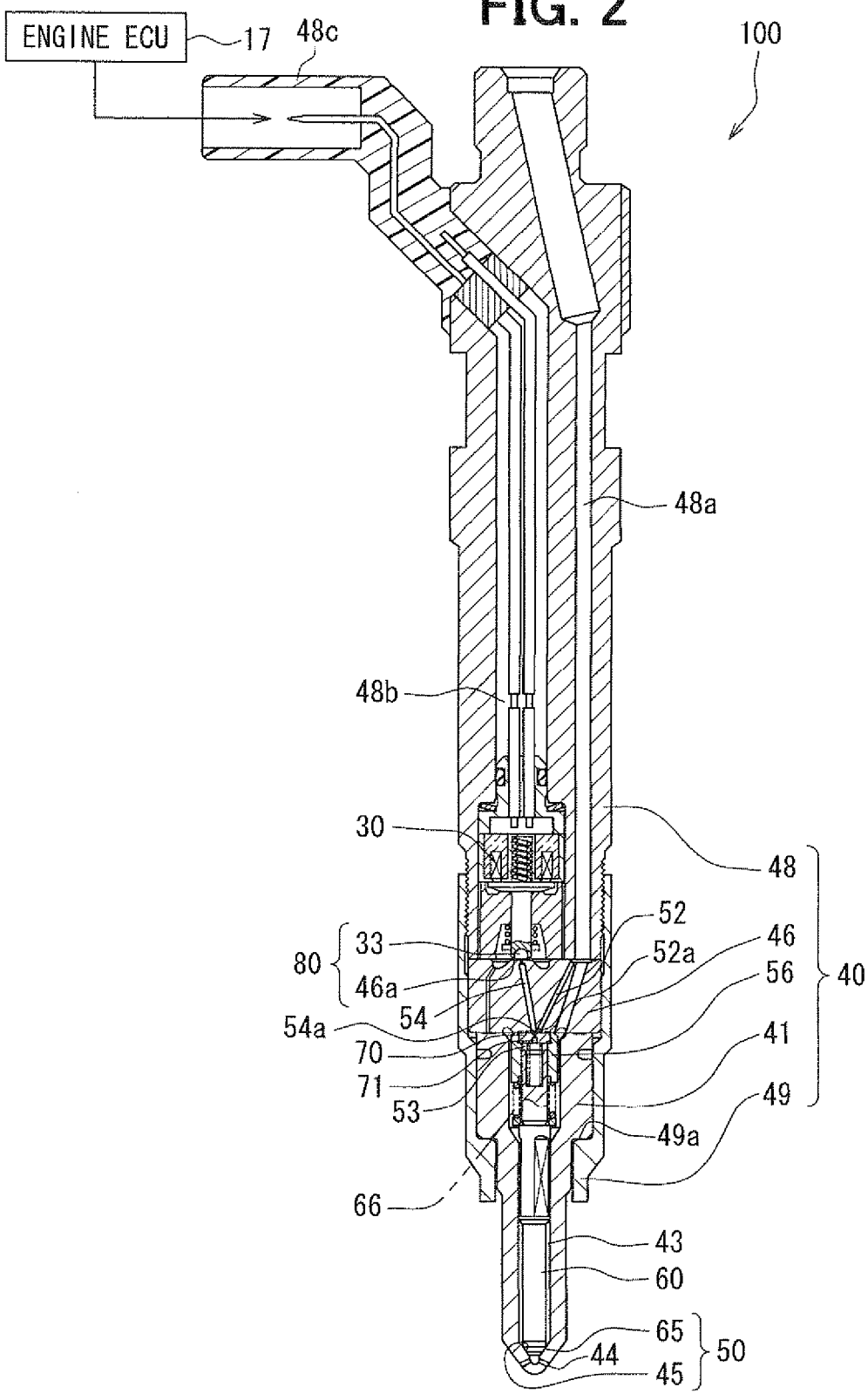
FIG. 2 is a longitudinal section view of the fuel injection device according to the first embodiment of the present invention.

Next, the structure of the fuel injection device 100 will be described in detail on the basis of FIG. 2 and FIG. 3.

The fuel injection device 100 includes a control valve driving part 30, a control body 40, a nozzle needle 60 and a floating plate 70.

The control valve driving part 30 is housed in the control body 40. The control valve driving part 30 is provided with a valve seat member 33 that forms a pressure control valve 80 together with a control valve seat portion 46*a* of the control body 40. The control valve driving part 30 opens or closes the pressure control valve 80 by receiving a supply of pulse current from the engine control device 17. When there is an electric power supply from the engine control device 17, the control valve driving part 30 causes the valve seat member 33 to be seated on the control valve seat portion 46*a*, and thereby the pressure control valve 80 is closed. When there is no an electric power supply from the engine control device 17, the control valve driving part 30 causes the valve seat member 33 to be separated from the control valve seat portion 46*a*, and thereby the pressure control valve 80 is opened.

The control body 40 has a nozzle body 41, a cylinder 56, an orifice plate 46, a holder 48, and a retaining nut 49. The nozzle body 41, the orifice plate 46 and the holder 48 are arranged in this order from a tip side in a direction in which they are inserted into the head member 21 having the injection holes 44 formed therein (see FIG. 1).

The control body 40 has an inflow channel 52, an outflow channel 54, a pressure control chamber 53, a supply channel 91 and a recovery channel 93, in addition to the plural injection holes 44. The injection holes 44 are provided at the tip end portion of the control body 40, so that high-pressure fuel can be injected to the fuel consumption chamber 22, as shown in FIG. 1. One end of the inflow channel 52 communicates with a side of the supply channel 14*d* (see FIG. 1) connected to the high-pressure fuel pump 13 and the common rail 14, and the other end of the inflow channel 52 communicates with the pressure control chamber 53. Thus, high-pressure fuel can be introduced into the pressure control chamber 53 via the inflow channel 52. One end of the outflow channel 54 communicates with a side of the return channel 14*f* (see FIG. 1) connected to the high-pressure fuel pump 13, and the other end of the outflow channel 54 communicates with the pressure control chamber 53. Thus, the fuel in the pressure control chamber 53 can flow toward the low-pressure side via the outflow channel 54.

The supply channel 91 is branched from the inflow channel 52 in the orifice plate 46, and is configured to communicate with the supply channel 14*d* (see FIG. 1) and the injection holes 44. Thus, high-pressure fuel can be supplied to the injection holes 44 via the supply channel 91. The recovery channel 93 is a fuel passage through which the fuel leaked from the supply channel 91 is recovered. The recovery channel 93 causes a space between the nozzle body 41 and the orifice plate 46, to communicate with the outflow channel 54. Therefore, the recovery channel 93 causes the fuel leaked between the nozzle body 41 and the orifice plate 46, to return to the outflow channel 54. As shown in FIG. 2, the supply channel 91 is provided in the orifice plate 46 and the nozzle body 41, so that the high-pressure fuel is supplied to the injection holes 44 via the supply channel 91.

The pressure control chamber 53 is partitioned by the orifice plate 46, the cylinder 56 and the like. The pressure control chamber 53 is provided in the control body 40 at a side opposite to the injection hole 44, with respect to the nozzle needle 60. The pressure control chamber 53 is configured, such that the high-pressure fuel is introduced therein from the inflow channel 52 and is discharged via the outflow channel 54.

The nozzle body 41 is a member made of a metal material such as chromium molybdenum steel or the like in the shape of a circular cylinder and closed at one end. The nozzle body 41 has a nozzle needle housing portion 43, a valve seat portion 45, and the injection hole 44. The nozzle needle housing portion 43 is formed along the axial direction of the nozzle body 41, and is a cylindrical hole in which a nozzle needle 60 is housed. Furthermore, the supply channel 91, through which the high-pressure fuel is supplied to the injection holes 44, is connected to the nozzle needle housing portion 43 within the nozzle body 41. The nozzle needle housing portion 43 is formed along the axial direction of the nozzle body 41, and is open at an end surface 42 of the nozzle body 41, which faces an end surface 47 of the orifice plate 46 in the axial direction. The end surface 42 of the nozzle body 41 is provided with a circular-ring shaped opening 92*b* of the supply passage 91, at a radial position between an outer peripheral wall of the cylinder 56 and an inner peripheral wall of the nozzle body 41 defining the nozzle needle housing portion 43. Similarly, the end surface 47 of the orifice plate 46 is provided with a circular-ring shaped opening 92*a* of the supply passage 91, which faces the circular-ring shaped opening 92*b*.

The valve seat portion 45 is formed on the bottom wall of the nozzle needle housing portion 43 and is brought into contact with the tip end of the nozzle needle 60. The nozzle hole 44 is located on the opposite side of the orifice plate 46 with respect to the valve seat portion 45. A plurality of the nozzle holes 44 are formed radially from the inside of the nozzle body 41 to the outside thereof. When the high-pressure fuel passes through the nozzle holes 44, the high-pressure fuel is atomized and diffused, thereby being brought into a state where the fuel is easily mixed with air.

The cylinder 56 made of a metal material forms a cylindrical wall portion that is formed in the shape of a circular cylinder and that defines the pressure control chamber 53 together with the orifice plate 46 and the nozzle needle 60. The cylinder 56 is a member made of a metal material in the shape of a circular cylinder, and is arranged coaxially with the nozzle needle housing portion 43 within the nozzle needle housing portion 43. In the cylinder 56, an end surface located on a side of the orifice plate 46 in the axial direction is held by the orifice plate 46.

The cylinder 56 is provided such that the nozzle needle 60 is slidable in the cylinder 56 along the axial direction of the nozzle needle 60. The cylinder 56 is configured to regulate the displacement of the floating plate 70 in the direction approaching the nozzle needle 60. Furthermore, the displacement of the nozzle needle 60 in the direction approaching the floating plate 70 can be regulated by the cylinder 56.

The orifice plate 46 is a member made of a metal material such as chromium molybdenum steel in the shape of a circular column, and is held between the nozzle body 41 and the holder 48. The orifice plate 46 is provided with the control valve seat portion 46*a*. The orifice plate 46 has therein the inflow channel 52, the outflow channel 54, the supply channel 91 and the recovery channel 93. The control valve seat portion 46*a* is formed at one end surface of the orifice plate 46 on a side of the holder 48 in the axial direction of the orifice plate 46, and constructs the pressure control valve 80 together with the valve seat member 33 of the control valve driving part 30 and the like. Furthermore, the other end surface 47 of the orifice plate 46, opposite to the control valve seat portion 46*a* in the axial direction is provided with a circular-ring shaped opening 92*a* of the supply channel 91. The opening 92*a* of the supply passage 91 is formed into a circular ring shape enclosing the inflow channel 52 and the outflow channel 54, and is concentric with a circular-ring shaped opening 92*b* formed at the end surface 42 of the nozzle body 41.

The holder 48 shown in FIG. 1 is a member made of a metal material such as chromium molybdenum steel in the shape of a cylinder, and has longitudinal holes 48*a*, 48*b* formed along the axial direction and has a socket portion 48*c*. The longitudinal hole 48*a* is a fuel channel that makes the supply channel 14*d* (see FIG. 1) communicate with the inflow channel 52. On the other hand, the longitudinal hole 48*b* has therein the control valve driving part 30 on a side of the orifice plate 46. In addition, in the longitudinal hole 48*b*, the socket portion 48*c* is formed at a portion on the opposite side of the orifice plate 46, in such a way as to close the opening of the longitudinal hole 48*b*. In addition, the socket portion 48*c* is detachably fitted with a plug portion (not shown) electrically connected to the engine control device 17. When the socket portion 48*c* is connected to the plug portion (not shown), a pulse current can be supplied to the control valve driving part 30 from the engine control device 17.

The retaining nut 49 is a member made of a metal material in the shape of a circular cylinder having two steps. The retaining nut 49 houses a portion of the nozzle body 41 and the orifice plate 46, and is screwed with a portion of the holder 48 on a side of the orifice plate 46. In addition, the retaining nut 49 has a stepped portion 49*a* on the inner peripheral wall portion thereof. When the retaining nut 49 is fitted to the holder 48, the stepped portion 49*a* presses the nozzle body 41 and the orifice plate 46 toward the holder 48. In this manner, the retaining nut 49 holds the nozzle body 41 and the orifice plate 46, together with the holder 48. The retaining nut 49 houses a portion of the nozzle body 41 and the orifice plate 46 to apply a force to the nozzle body 41 and the orifice plate 46 in the axial direction, so that the end surface 42 of the nozzle body 41 and the end surface 47 of the orifice plate 46 liquid-tightly contact with each other.

The nozzle needle 60 is formed of a metal material such as high-speed tool steel in the shape of a circular column as a whole, and is movable in the control body 40 along the axial direction of the control body 40. Furthermore, the nozzle needle 60 has a seat portion 65, a pressure receiving surface 61 and a return spring 66. The seat portion 65 is formed on an end portion, which is one of both end portions in the axial direction of the nozzle needle 60 and is arranged opposite to the pressure control chamber 53, and is seated on the valve seat portion 45 of the control body 40. A valve portion 50 for opening and closing the injection holes 44 is configured by the valve seat portion 45 and the seat portion 65. The pressure receiving surface 61 is formed of an end portion, which is one of both end portions in the axial direction of the nozzle needle 60, and is arranged at a side of the pressure control chamber 53, opposite to the seat portion 65. The pressure receiving surface 61 partitions the pressure control chamber 53 together with the orifice plate 46 and the cylinder 56, and receives the pressure of the fuel in the pressure control chamber 53. The return spring 66 is a coil spring made by winding a metal wire in the shape of a circle. The return spring 66 causes the nozzle needle 60 to be biased to the side of the valve portion 50. Thus, the nozzle needle 60 is capable of reciprocating with respect to the cylinder 56 along the axial direction of the cylinder 56, based on the spring force of the return spring 66 and the pressure of the fuel in the pressure control chamber 53. Here, the pressure of the fuel in the pressure control chamber 53 is applied to the pressure receiving surface 61. Thus, the seat portion 65 can seat on the valve seat portion 45 and can be separated from the valve seat portion 45, so that the nozzle needle 60 closes or opens the valve portion 50.

The floating plate 70 is a member made of a metal material in the shape of a circular disk, and is capable of pressing the end surface 47 of the orifice plate 46 so as to close the inflow channel 52. The end surface of the orifice plate 46 defines the pressure control chamber 53. A communication hole 71 is provided in the floating plate 70 to penetrate through the floating plate 70 in the axial direction. In addition, the floating plate 70 is arranged coaxially with the cylinder 56 in the pressure control chamber 70 to be displaced in the axial direction. The floating plate 70 is biased to the side of the orifice plate 46 with respect to the nozzle needle 60, by a coil spring 72 made of a metal and wound circumferentially.

The floating plate 70 is a member made of a metal material in the shape of a circular disk, and is capable of pressing the end surface 47 of the orifice plate 46 so as to close the inflow channel 52. The floating plate 70 is moved toward the orifice plate 46 by the flow of the fuel flowing out of the pressure control chamber 53, so as to be pressed to the end surface 47 of the orifice plate 46. In this case, the floating plate 70 closes the inflow passage 52, thereby preventing a flow of high-pressure fuel flowing into the pressure control chamber 53. When the floating plate 70 is separated from the end surface 47 of the orifice plate 46, the fuel in the pressure control chamber 53 flows to the outflow channel 54 via the communication hole 71. Thus, the floating plate 70 can facilitate a decrease in the pressure of the pressure control chamber 53.

Thus, the floating plate 70 arranged in the pressure control chamber 53 can improve responsibility of the valve portion 50 at a valve open time.

Figure 3:
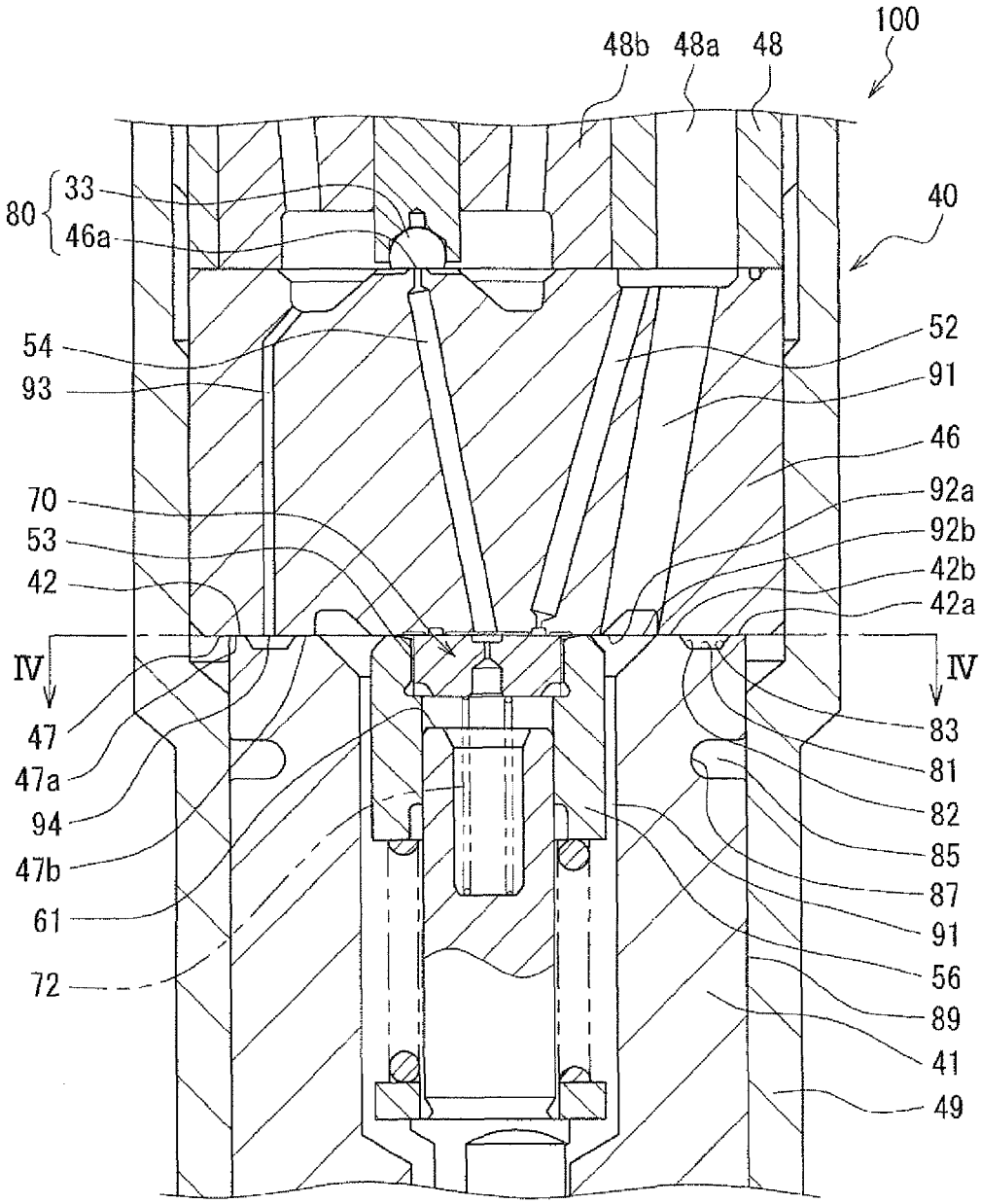
FIG. 3 is a partially enlarged view showing a portion of the fuel injection device according to the first embodiment of the present invention.
Figure 4:
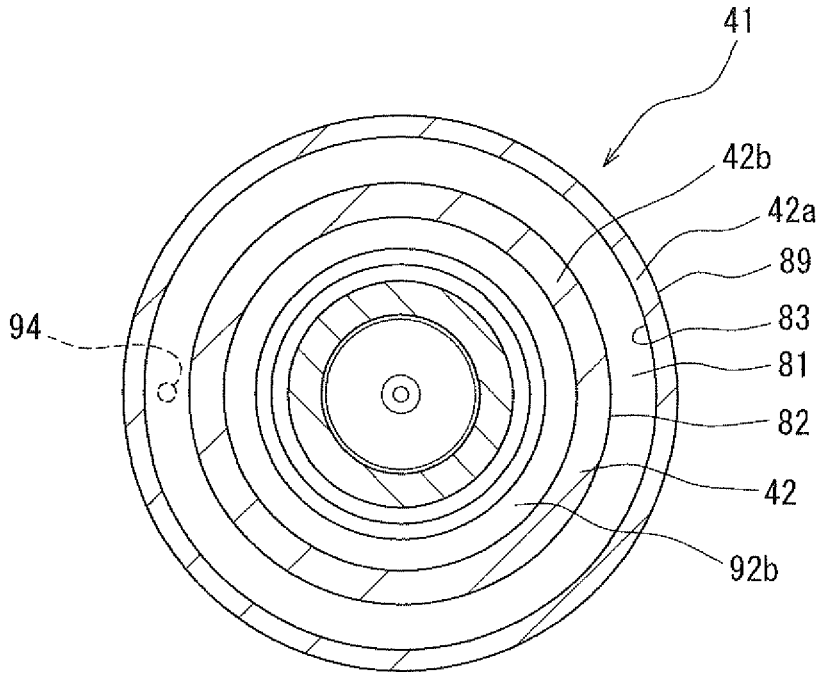
FIG. 4 is a cross-sectional view taken along the line IV-IV of FIG. 3.
Figure 5:
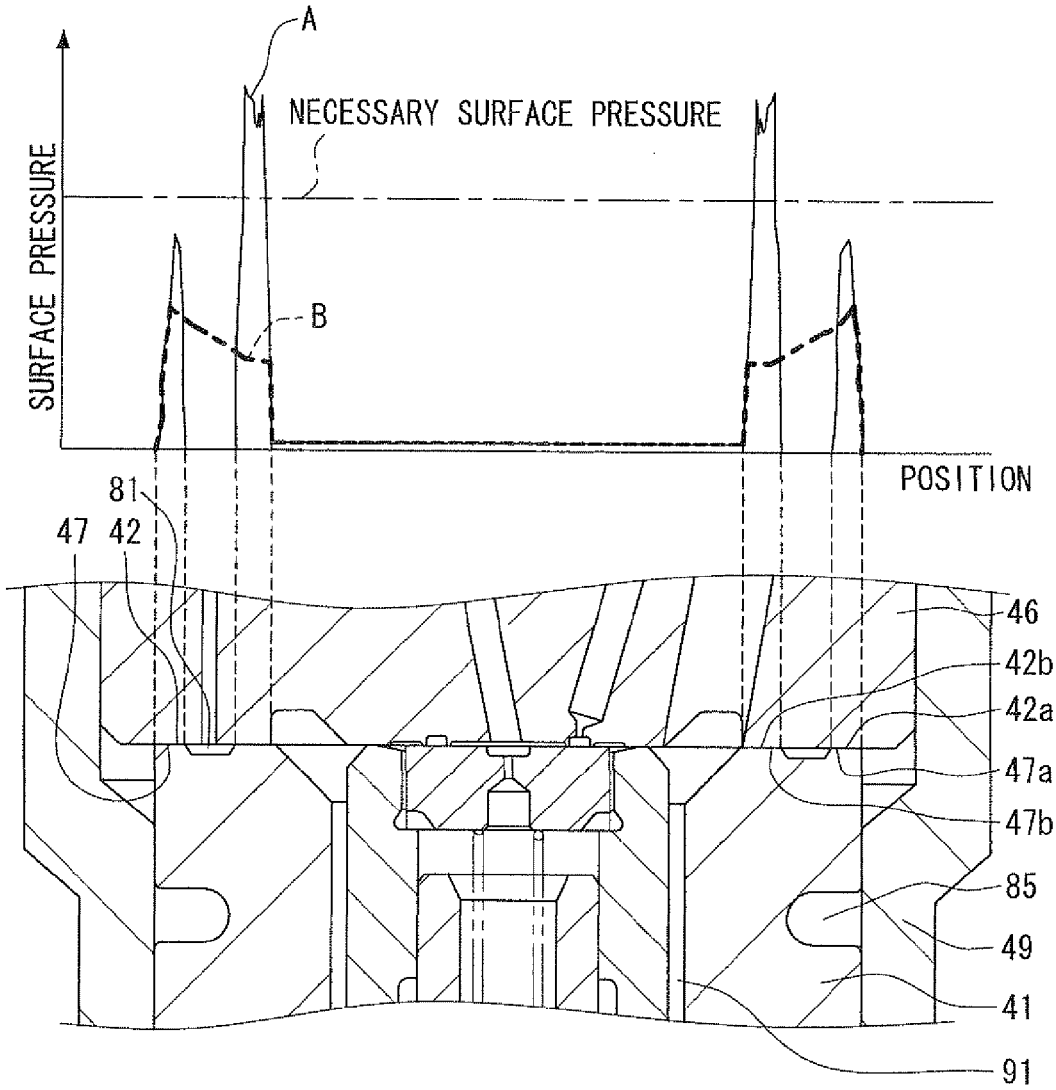
FIG. 5 is a schematic diagram showing effects, due to an end surface groove and a side surface groove, for increasing a surface pressure generated between a nozzle body and an orifice plate, according to the first embodiment of the present invention.

Next, the featured portion of the fuel injection device 100 will be further described in detail on the basis of FIG. 3 to FIG. 5.

As shown in FIGS. 3 and 4, the nozzle body 41 is provided with an end surface groove 81 and a side surface groove 85. The end surface groove 81 is formed in a circular ring shape at the end surface 42 of the nozzle body 41. The end surface groove 81 is formed concentrically with the opening 92*b* of the supply passage 91 formed in the nozzle body 41, radially outside of the opening 92*b* to continuously enclose the entire outer periphery of the opening 92*b*. The end surface groove 81 is separated from the opening 92*b* by a predetermined radial dimension. That is, the end surface groove 81 and the opening 92*b* are partitioned from each other by a circular-ring shaped high-pressure seal surface portion 42*b*. The end surface groove 81 is defined by an inner peripheral portion 82 and an outer peripheral portion 83, and the opening 94 of the recovery channel 93 formed in the orifice plate 46 is positioned in the end surface groove 81 between the inner peripheral portion 82 and the outer peripheral portion 83 in the radial direction. With the above configuration, the end surface groove 81 is connected to the recovery channel 93. A low-pressure seal surface portion 42*a* is formed into a circular ring shape at an outer peripheral side of the end surface groove 81.

A low-pressure seal surface portion 47*a* is provided in the end surface 47 of the orifice plate 46 at an outer peripheral side of the end surface groove 81, in an area facing the low-pressure seal surface portion 42*a* of the nozzle body 41. A high-pressure seal surface portion 47*b* is provided in the end surface 47 of the orifice plate 46 at an inner peripheral side of the end surface groove 81, in an area facing the high-pressure seal surface portion 42*b* of the nozzle body 41.

Furthermore, a side surface groove 85 is formed in an outer peripheral surface 89 of the nozzle body 41 to extend along an entire periphery of the outer peripheral surface 89. The side surface groove 85 is formed into a circular ring shape concentrically with the end surface groove 81 formed in the nozzle body 41 and concentrically with each opening 92*a*, 92*b* of the supply channel 91 formed in the orifice plate 46 and the nozzle body 41. The side surface groove 85 is provided with a recess bottom portion 87 recessed radially inside than the outer peripheral portion 83 of the end surface groove 81. That is, the recess bottom portion 87 of the side surface groove 85 is positioned radially inside, than the outer peripheral portion 83 of the end surface groove 81.

In the graph of FIG. 5, A indicates a surface pressure generated between the end surfaces 42, 47 in the state where the end surface groove 81 and the side surface groove 85 are provided according to the first embodiment, and B indicates a surface pressure generated between the end surfaces 42, 47 in the state where the end surface groove 81 and the side surface groove 85 are not provided as a comparison example. As shown in the chain line B of FIG. 5, in the case where the end surface groove 81 and the side surface groove 85 are not formed, the surface pressure generated between the end surfaces 42, 47 is gradually increased from the inner periphery toward the outer periphery. In this case, it is difficult to generate a necessary surface pressure for sealing when the pressure of the fuel in the supply channel 91 becomes remarkably high, because the applied force is distributed in the entire end surface area between the end surfaces.

In the present embodiment, the nozzle body 41 is provided with the end surface groove 81 and the side surface groove 85. Because the side surface groove 85 is formed, the strength of the outer peripheral side of the nozzle body 41 is lower than the strength of the inner peripheral side of the nozzle body 41. Therefore, the low-pressure seal surface portion 42*a* can be easily deformed in the axial direction than the high-pressure seal surface portion 42*b*, on the end surface 42 of the nozzle body 41. When the retaining nut 49 applies an axial force to the nozzle body 41 and the orifice plate 46, the force applied by the retaining nut 49 is collected and concentrically applied to the high-pressure seal surface portion 42*b*, 47*b*. Thus, as shown by the solid line A in FIG. 5, a high surface pressure is caused between the high-pressure seal surface portions 42*b*, 47*b* at an inner peripheral side of the end surface groove 81, as compared with that between the low-pressure seal surface portions 42*a*, 47*a* at an outer peripheral side of the end surface groove 81. Thus, it is possible to generate a necessary surface pressure between the high-pressure seal surface portions 42*b*, 47*b* when the pressure of the fuel in the supply channel 91 becomes remarkably high.

As a distance from the end surface 42 to the side surface groove 85 becomes shorter in the axial direction of the nozzle body 41, a difference between the surface pressure generated between the high-pressure seal surface portions 42*b*, 47*b*, and the surface pressure generated between the low-pressure seal surfaces 42*a*, 47*a* becomes larger. By setting the position of the bottom portion 87 of the side surface groove 85 radially inside of the outer peripheral portion 83 of the end surface groove 81 as shown in FIG. 3, the difference between the surface pressure generated between the high-pressure seal surface portions 42*b*, 47*b*, and the surface pressure generated between the low-pressure seal surfaces 42*a*, 47*a* becomes larger. The distance from the end surface 42 to the side surface groove 85 and the recess dimension of the side surface groove 85 are adjusted so as to have a suitable surface pressure between the high-pressure seal surface portions 42*b*, 47*b*, thereby preventing a leakage of the fuel from the supply channel 91.

As described above, according to the first embodiment, even when the pressure in the supply passage 91 is abnormally increased, the high-pressure seal surface portions 42*b*, 47*b* of the end surfaces 42, 47 can liquid-tightly contact with each other, to be sealed therebetween. Thus, it is possible to effectively reduce an amount of the leakage fluid leaked from the supply channel 91 to the end surface groove 81, via the space between the high-pressure seal surface portions 42*b*, 47*b*. Therefore, a recovery of the leakage fluid via the recovery channel 93 connected to the end surface groove 81 can be accurately performed, thereby preventing an increase of the fuel pressure in the recovery channel 93 and the end surface groove 81. Thus, even when the surface pressure generated between the low-pressure seal surface portions 42*a*, 47*a* positioned at the outer peripheral side of the end surface groove 81 is low, it can effectively prevent a leakage of the fuel from the low-pressure seal surface portions 42*a*, 47*a*. As a result, according to the present embodiment, the fuel injection device 100 can effectively prevent a leakage of the fuel from the supply channel 91 to the outside.

According to the first embodiment, because the bottom portion 87 of the side surface groove 85 is positioned radially inside of the outer peripheral portion 83 of the end surface groove 81, the low-pressure seal surface portion 42*a* can be easily deformed as compared with the high-pressure seal surface portion 42*b* in the nozzle body 41. Therefore, the force applied by the retaining nut 49 can be further concentrically applied to the area between the high-pressure seal surface portions 42*b*, 47*b* positioned radially inside of the end surface groove 81, and thereby it is possible to liquid-tightly contact the high-pressure seal surface portions 42*b*, 47*b*.

In the first embodiment, the recovery channel 93 is formed in the orifice plate 46, and the side surface groove 85 is formed in the nozzle body 41. Thus, the side surface groove 85 can be suitably formed at an optimal position with an optimal shape without interfering with the position of the recovery channel 93. Accordingly, the force obtained by the retaining nut 49 can be concentrically applied to the area between the high-pressure seal surface portions 42*b*, 47*b*, thereby improving the effects due to the side surface groove 85. Therefore, the high-pressure seal surface portions 42*b*, 47*b* can be further liquid-tightly abutted on each other.

According to the first embodiment, because the side surface groove 85 is formed along the entire periphery of the outer peripheral surface 89 of the nozzle body 41, the low-pressure seal surface portion 42*a* can be easily deformed as compared with the high-pressure seal surface portion 42*b*. Thus, when the force is applied from the retaining nut 49 to the nozzle body 41 and the orifice plate 46 in the axial direction, a high surface pressure can be applied to each of the high-pressure seal surface portion 42*b*, 47*b*, as compared with the low-pressure seal surface portions 42*a*, 47*a*. Therefore, the high-pressure seal surface portions 42*b*, 47*b* can be further liquid-tightly abutted on each other.

According to the first embodiment, the high-pressure seal surface portions 42*b*, 47*b* are tightly abutted on each other by a predetermined width around the openings 92*a*, 92*b*. Furthermore, both the end surface groove 81 and the side surface groove 85 have circular-ring shapes, so that the force applied by the retaining nut 49 can be applied in uniform in the circumferential direction between the high-pressure seal surface portions 42*b*, 47*b*. Thus, the surface pressure generated between the high-pressure seal surface portions 42*b*, 47*b* can be applied in uniform in the circumferential direction. Accordingly, the high-pressure seal surface portions 42*b*, 47*b* can be liquid-tightly sealed between the end surface 42 and the end surface 47 of the nozzle body 41 and the orifice plate 46.

Furthermore, because a leakage of the fuel from the supply channel 91 to the end surface groove 81 can be reduced, it can accurately prevent an increase of the fuel pressure in the recovery channel 93 and the end surface groove 81. Therefore, a leakage of the fuel to an outside of the fuel injection device 100 can be accurately prevented.

According to the first embodiment, because the end surface groove 81 is continuously formed in the circumferential direction to entirely enclose the circular-ring shaped openings 92*a*, 92*b* communicating with the supply channel 91, the fuel leaked between the end surfaces 42, 47 can be accurately recovered and can be discharged through the recovery channel 93. Because the end surface groove 81 is formed to continuously in the circumferential direction to entirely enclose the openings 92*a*, 92*b* radially outside of the openings 92*a*, 92*b*, it can prevent the fuel from being leaked outside of the fuel supply device 100 without being recovered in the end surface groove 81 and the recovery passage 93.

In the above-described embodiment, the orifice plate 46 having the supply channel 91 and the recovery channel 93 is used as a first valve body having a first end surface, the nozzle body 41 having the supply channel 91 is used as a second valve body having a second end surface facing the first end surface, and the retaining nut 49 is used as a force applying member for applying a force to the first valve body and the second valve body, such that the first end surface and the second end surface liquid-tightly contact each other by using the applied force from the force applying member, as an example. However, the first valve body, the second valve body and the force applying member are not limited to the above example, and may be suitably modified.

Second Embodiment

Figure 6:
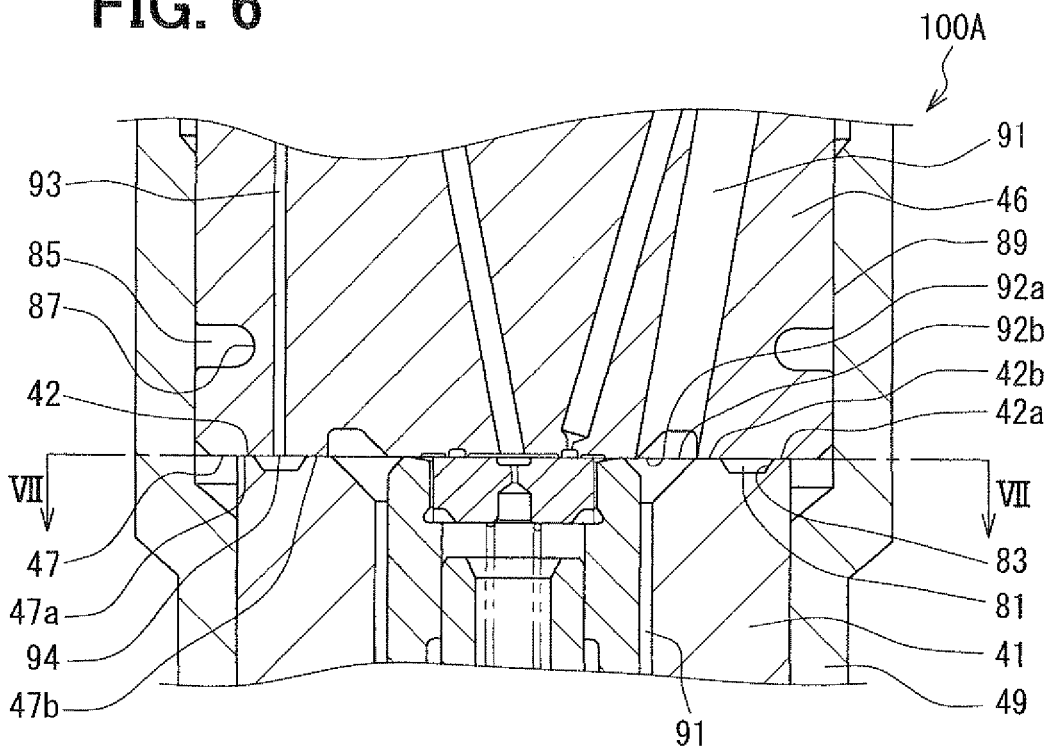
FIG. 6 is a partially enlarged view showing a part of a fuel injection device according to a second embodiment of the present invention.
Figure 7:
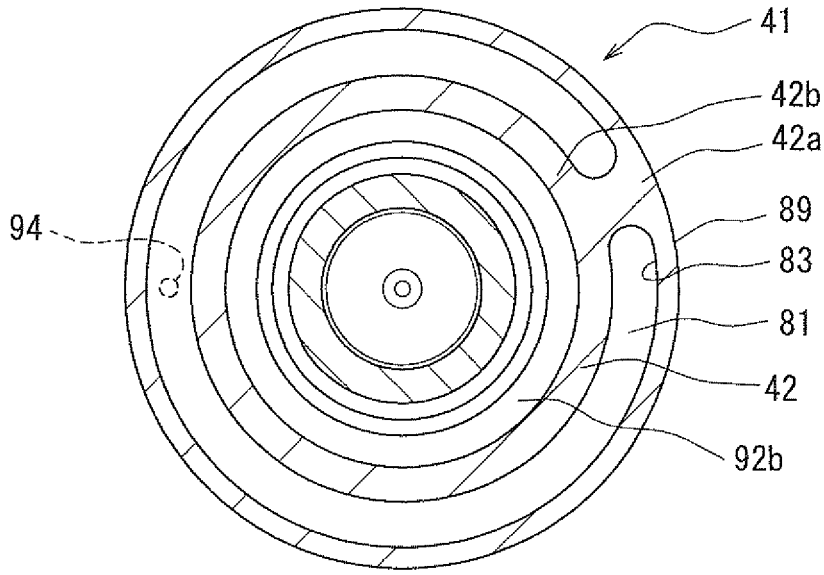
FIG. 7 is a cross-sectional view taken along the line VII-VII of FIG. 6.

A second embodiment of the present invention will be described with reference to FIGS. 6 and 7. The second embodiment is a modified example of the above-described first embodiment. In a fuel injection device 100A of the second embodiment, the shape of the end surface groove 81 formed in the end surface 42 of the nozzle body 41 is different from the end surface groove 81 of the above-described first embodiment. Furthermore, the side surface groove 85 is not formed in the nozzle body 41, but is formed in the orifice plate 46. Next, the detail structure of the fuel injection device 100A according to the second embodiment will be described.

The end surface groove 81 is formed in the end surface 42 of the nozzle body 41 concentrically with the opening 92*b* of the supply passage 91 formed in the nozzle body 41, radially outside of the circular-ring shaped opening 92*b* to enclose the circular outer periphery of the opening 92*b*. In the second embodiment, the end surface groove 81 is not formed into a circular-ring shape continuously extending in the circumferential direction. The end surface groove 81 is not formed in a part area of the circular ring, as shown in FIG. 7. In the second embodiment, the low-pressure seal surface portion 42*a* is formed at an outer peripheral side of the end surface groove 81, and the high-pressure seal surface portion 42*b* is formed at an inner peripheral side of the end surface groove 81, similarly to the above-described first embodiment.

As described above, in the second embodiment, the side surface groove 85 is formed in an outer peripheral surface 89 of the orifice plate 46. The side surface groove 85 is formed in the outer peripheral surface 89 of the orifice plate 46 to extend along the entire periphery of the outer peripheral surface 89. The side surface groove 85, the end surface groove 81 and the openings 292*a*, 292*b* are formed concentrically in the nozzle body 41 and the orifice plate 46. The supply channel 91 is formed in the orifice plate 46 and the nozzle body 41, and is opened at the end surfaces 47, 42 of the orifice plate 46 and the nozzle body 41 by the openings 92*a*, 92*b*. The side surface groove 85 is formed at a position without providing the recovery channel 93 in the orifice plate 46. In addition, the recess bottom portion 87 of the side surface groove 85 is positioned radially outside of the outer periphery 83 of the end surface groove 81 formed in the nozzle body 41.

Because the side surface groove 85 is formed, the strength of the outer peripheral side of the orifice plate 46 is lower than the strength of the inner peripheral side of the orifice plate 46. Therefore, the low-pressure seal surface portion 47*a* facing the low-pressure seal surface portion 42*a* of the nozzle body 41 can be easily deformed in the axial direction than the high-pressure seal surface portion 47*b* facing the high-pressure seal surface portion 42*b* of the nozzle body 41, on the end surface 47 of the orifice plate 46. When the retaining nut 49 applies an axial force to the nozzle body 41 and the orifice plate 46, the force applied by the retaining nut 49 can be collected and concentrically applied to the high-pressure seal surface portion 42*b*, 47*b*. Thus, a high surface pressure is caused between the high-pressure seal surface portions 42*b*, 47*b* at an inner peripheral side of the end surface groove 81, as compared with that between the low-pressure seal surface portions 42*a*, 47*a* at an outer peripheral side of the end surface groove 81, on the end surfaces 42 and 47. Thus, it is possible to generate a necessary surface pressure between the high-pressure seal surface portions 42*b*, 47*b* when the pressure of the fuel in the supply channel 91 becomes remarkably high.

As described above, according to the first embodiment, even when the pressure in the supply passage 91 is abnormally increased, the high-pressure seal surface portions 42*b*, 47*b* of the end surfaces 42, 47 can liquid-tightly contact each other, to be tightly sealed therebetween. Thus, it is possible to effectively reduce an amount of the leakage fuel leaked from the supply channel 91 to the end surface groove 81, via the space between the high-pressure seal surface portions 42*b*, 47*b*. Therefore, a recovery of the leakage fuel via the recovery channel 93 connected to the end surface groove 81 can be effectively performed, thereby preventing an increase of the fuel pressure in the recovery channel 93 and the end surface groove 81. Thus, a leakage of the fuel from between the low-pressure seal surface portions 42*a*, 47*a* can be prevented.

As described above, in the fuel injection device 100A of the second embodiment, the side surface groove 85 is formed in the orifice plate 46, and the recess bottom portion 87 of the side surface groove 85 is positioned radially outside of the outer periphery 83 of the end surface groove 81. Even in this case, a leakage of the fuel to the outside of the fuel injection device 100A can be accurately prevented. In the second embodiment, the other parts are similar to those of the above-described first embodiment, and detail explain thereof is omitted.

Third Embodiment

Figure 8:
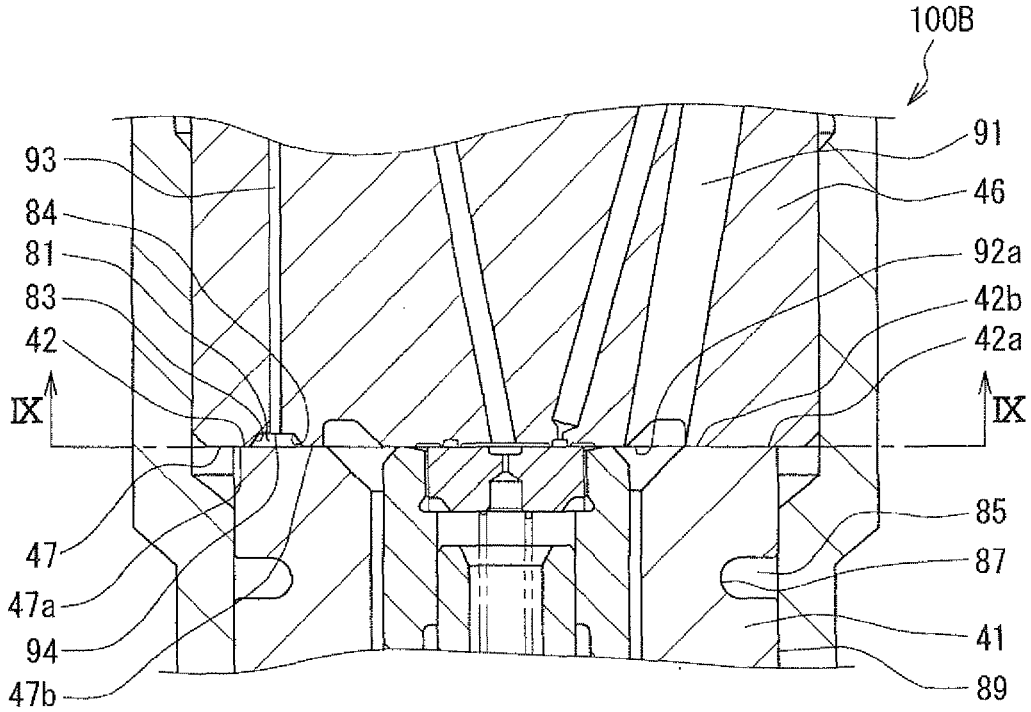
FIG. 8 is a partially enlarged view showing a part of a fuel injection device according to a third embodiment of the present invention.
Figure 9:
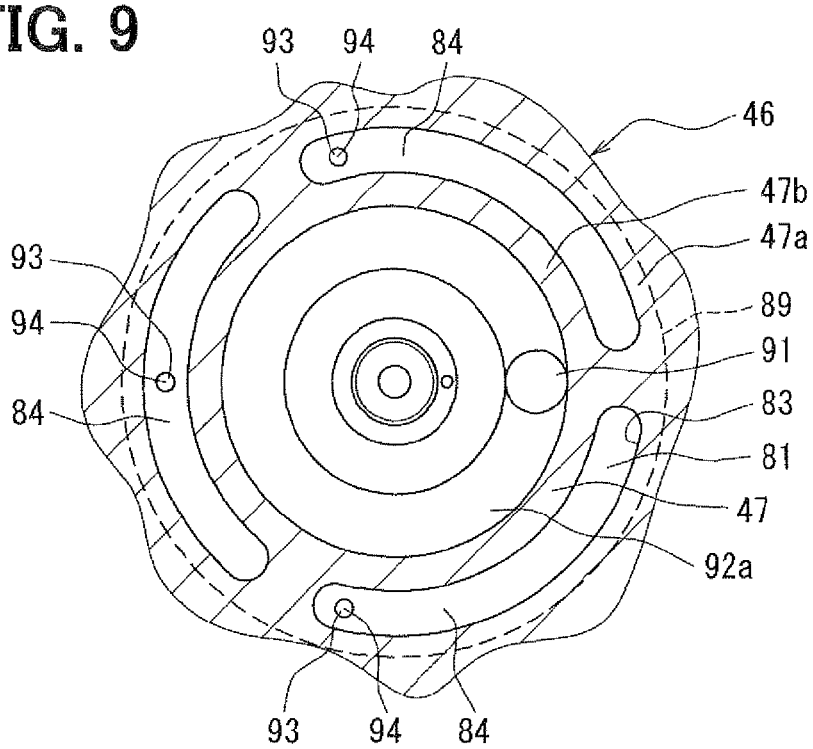
FIG. 9 is a cross-sectional view taken along the line IX-IX of FIG. 8.

A third embodiment of the present invention will be described with reference to FIGS. 8 and 9. The third embodiment is another modified example of the above-described first embodiment. In the above-described first embodiment, the end surface groove 81 is formed in the end surface 42 of the nozzle body 41. However, in a fuel injection device 1008 of the third embodiment, an end surface groove 81 is formed in the end surface 47 of the orifice plate 46. Hereinafter, the construction of the fuel injection device 100B according to the third embodiment will be described in detail.

In the third embodiment, the end surface groove 81 is formed in the end surface 47 of the orifice plate 46 concentrically with the opening 92*a* of the supply passage 91 formed in the orifice plate 46, radially outside of the opening 92*b* to partially enclose the circular outer periphery of the opening 92*a* of the supply channel 91 formed in the orifice plate 46. In the third embodiment, the end surface groove 81 is not formed into a circular-ring shape continuously extending in the circumferential direction. The end surface groove 81 is divided into three end surface groove parts 81 arranged in the circumferential direction and separated from each other in the circumferential direction. Openings 94 of the recovery channel 93 are formed respectively in bottom portions 84 of the separated end surface groove parts 81. With the above configuration, the end surface groove parts 81 respectively communicate with the recovery channels 93. All the recovery channels 93 are connected to the outflow channel 54 (refer to FIG. 2). Thus, even if the fuel is leaked from any one of the end surface groove parts 81 from the supply channel 91, the leaked fuel can be recovered via the recovery channel 93. Even in the third embodiment, the low-pressure seal surface portion 47*a* is formed radially outside of the end surface groove 81, and the high-pressure seal surface portion 47*b* is formed radially inside of the end surface groove 81, similarly to the above-described first embodiment.

In addition, in the fuel injection device 100B of the third embodiment, the end surface groove 81 described in the first embodiment is not provided in the end surface 42 of the nozzle body 41. On the other hand, the side surface groove 85 is formed in the outer peripheral surface 89 of the nozzle body 41, similarly to the above-described first embodiment. The side surface groove 85 is provided with the recess bottom portion 87 recessed radially inside than the outer peripheral portion 83 of the end surface groove parts 81 of the orifice plate 46. That is, the recess bottom portion 87 of the side surface groove 85 is positioned radially inside, than the outer peripheral portion 83 of the end surface groove parts 81 arranged in a circumferential direction. Because the side surface groove 85 is formed, the strength of the outer peripheral side of the nozzle body 41 is lower than the strength of the inner peripheral side of the nozzle body 41, similarly to the above-described first embodiment.

The low-pressure seal surface portion 47*a* is provided in the end surface 47 of the orifice plate 46 at an outer peripheral side of the end surface groove parts 81, in an area facing the low-pressure seal surface portion 42*a* of the nozzle body 41. Furthermore, the high-pressure seal surface portion 47*b* is provided in the end surface 47 of the orifice plate 46 at an inner peripheral side of the end surface groove parts 81, in an area facing the high-pressure seal surface portion 42*b* of the nozzle body 41. Therefore, the low-pressure seal surface portion 42*a* can be easily deformed in the axial direction than the high-pressure seal surface portion 42*b*, in the nozzle body 41. Thus, a high surface pressure can be generated between the high-pressure seal surface portions 42*b*, 47*b* at an inner peripheral side of the end surface groove 81, as compared with that between the low-pressure seal surface portions 42*a*, 47*a* at an outer peripheral side of the end surface groove 81, in the end surfaces 42 and 47. Accordingly, it is possible to generate a necessary surface pressure between the high-pressure seal surface portions 42*b*, 47*b* when the pressure of the fuel in the supply channel 91 becomes remarkably high.

As described above, according to the third embodiment, even when the pressure in the supply passage 91 is abnormally increased, the high-pressure seal surface portions 42*b*, 47*b* of the end surfaces 42, 47 can liquid-tightly contact each other, to be liquid-tightly sealed therebetween. Thus, it is possible to effectively reduce an amount of the leakage fuel leaked from the supply channel 91 to the end surface groove 81, via the space between the high-pressure seal surface portions 42*b*, 47*b*. Therefore, a recovery of the leakage fuel via the recovery channel 93 connected to the end surface groove 81 can be accurately performed, thereby preventing an increase of the fuel pressure in the recovery channel 93 and the end surface groove 81. Thus, a leakage of the fuel from between the low-pressure seal surface portions 42*a*, 47*a* can be prevented.

As described above, in the fuel injection device 100B of the third embodiment, the end surface groove 81 is divided into plural end surface groove parts 81 arranged in a circumferential direction. Even in this case, a leakage of the fuel to the outside of the fuel injection device 100B can be accurately prevented.

In the third embodiment, the other parts may be similar to those of the above-described first or second embodiment.

Other Embodiments

Although the present invention has been fully described in connection with the preferred embodiments thereof with reference to the accompanying drawings, it is to be noted that various changes and modifications will become apparent to those skilled in the art.

In the above-described embodiments, the end surface groove 81 and the side surface groove 87 are formed in any one of the orifice plate 46 (first valve body) and the nozzle body 41 (second valve body). However, the end surface groove 81 may be formed in both the orifice plate 46 and the nozzle body 41, or/and the side surface groove 87 may be formed in both the orifice plate 46 and the nozzle body 41.

In the above-described embodiments, the side surface groove 87 is formed in the outer periphery of the nozzle body 41 or the orifice plate 46 to extend along the entire outer periphery. However, the side surface groove 87 may be partially provided in the outer periphery of the nozzle body 41 or the orifice plate 46. For example, the side surface groove 87 may partially extend in a circumferential direction of the outer periphery of the nozzle body 41 or the orifice plate 46, or may be divided into plural groove parts arranged in a circumferential direction of the outer periphery of the nozzle body 41. Alternatively, plural small holes formed in the circumferential direction of the outer periphery of the nozzle body 41 or the orifice plate 46 may be used as the side surface groove 87.

In the above-described embodiments, the supply channel 91 for supplying the fuel to the injection holes 44 is formed in the nozzle body 41 and the orifice plate 46, and is opened by the openings 92*a*, 92*b* in the circular-ring shape at the end surfaces 42, 47 of the nozzle body 41 and the orifice plate 46. However, the openings 92*a*, 92*b* may be formed into other shapes without being limited to the circular-ring shape. The supply channel 91 may be open in a circular shape at the end surfaces 42, 47 of the nozzle body 41 and the orifice plate 46.

In the above-described embodiments, the end surface groove 81, the side surface groove 85 and the openings 92*a*, 92*b* of the supply channel 91 are formed into concentric circular rings. However, the end surface groove 81, the side surface groove 85 and the openings 92*a*, 92*b* may be formed into other shapes without being limited to the circular rings. Furthermore, the end surface groove 81, the side surface groove 85 and the openings 92*a*, 92*b* of the supply channel 91 may be formed eccentrically.

In the above-described embodiments, the end surface groove 81 and the side surface groove 85 are formed in at least one of the nozzle body 41 and the orifice plate 46, thereby preventing a leakage of the fuel leaked from between the nozzle body 41 and the orifice plate 46. However, the end surface groove 81 and the side surface groove 85 may be formed in at least one of the orifice plate 46 and the holder 48, thereby preventing a leakage of the fuel from between the orifice plate 46 and the holder 48, for example. Similarly, the end surface groove 81 and the side surface groove 85 may by formed in adjacent two valve body members without being limited to the nozzle body 41 and the orifice plate 46.

In the above-described embodiments, as the drive portion for opening and closing the pressure control valve 80, a mechanism for driving the movable member 35 by using the electromagnetic force of the solenoid 31 is used. However, a drive portion other than the solenoid 31, e.g., a piezo-electric element, may be used. Even in this case, the drive portion for opening and closing the pressure control valve 80 may be operated based on the control signal from the engine controller 17.

In the above embodiments, the present invention is applied to the fuel injection device used for the diesel engine 20 that injects fuel directly into the combustion chamber 22. However, the present invention may be applied to a fuel injection device for any internal combustion engine, without being limited to the diesel engine 20. In addition, the fuel injected by the fuel injection device is not limited to light oil but may be gasoline, liquefied petroleum gas, and like. Furthermore, the present invention may be applied to a fuel injection device that injects fuel to a combustion chamber of an engine for burning fuel, such as an external combustion engine.

Such changes and modifications are to be understood as being within the scope of the present invention as defined by the appended claims.

What is claimed is:

1. A fuel injection device, which is provided with a fuel channel through which a high-pressure fuel is supplied to an injection hole, and a recovery channel through which the fuel leaked from the fuel channel is recovered, the fuel injection device comprising:

a first valve body in which the fuel channel and the recovery channel are provided, the first valve body having a first end surface at which the fuel channel is opened by an opening;

a second valve body in which the fuel channel is formed, the second valve body having a second end surface at which the fuel channel is opened by an opening, the second end surface of the second valve body facing the first end surface of the first valve body; and a force applying member disposed to apply a force to the first valve body and the second valve body, such that the first end surface and the second end surface liquid-tightly contact each other by using the applied force from the force applying member, wherein one of the first end surface and the second end surface is provided with an end surface groove connected to the recovery channel, the end surface groove is provided to enclose at least a part of the opening and is separated from the opening by a clearance, and at least one of the first valve body and the second valve body has a side surface groove extending in a circumferential direction at an outer periphery of the at least one of the first valve body and the second valve body.

2. The fuel injection device according to claim 1, wherein the side surface groove is recessed radially inside from the outer periphery of the one of the first valve body and the second valve body to have a recessed bottom, and the recessed bottom is positioned radially inside of an outer periphery of the end surface groove.

3. The fuel injection device according to claim 1, wherein the side surface groove is provided in the second valve body.

4. The fuel injection device according to claim 1, wherein the side surface groove is provided along an entire periphery of at least one of the first valve body and the second valve body.

5. The fuel injection device according to claim 1, wherein the end surface groove is provided to continuously extend in a circumferential direction around an outer periphery of the opening of the fuel channel.

6. The fuel injection device according to claim 1, wherein the openings of the fuel channel opened respectively at the first end surface and the second end surface are circular shapes or circular ring shapes, which are concentric with each other, and the end surface groove and the side surface groove have respectively circular ring shapes that are concentric with the openings of the fuel channel respectively opened at the first end surface and the second end surface.

* * * * *